US011958511B2

(12) United States Patent
Tao et al.

(10) Patent No.: US 11,958,511 B2
(45) Date of Patent: Apr. 16, 2024

(54) TRAIN SIGNAL SYSTEM AND LINKAGE METHOD THEREFOR

(71) Applicant: BYD COMPANY LIMITED, Shenzhen (CN)

(72) Inventors: Xuelian Tao, Shenzhen (CN); Bing Hui, Shenzhen (CN); Chunmei Pan, Shenzhen (CN); Haijun Huang, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 258 days.

(21) Appl. No.: 17/633,346

(22) PCT Filed: Aug. 12, 2020

(86) PCT No.: PCT/CN2020/108730
§ 371 (c)(1),
(2) Date: Feb. 7, 2022

(87) PCT Pub. No.: WO2021/027852
PCT Pub. Date: Feb. 18, 2021

(65) Prior Publication Data

US 2022/0297731 A1 Sep. 22, 2022

(30) Foreign Application Priority Data

Aug. 14, 2019 (CN) ..... 201910748535.X

(51) Int. Cl.
*B61L 27/20* (2022.01)
*B61L 15/00* (2006.01)

(52) U.S. Cl.
CPC ..... *B61L 15/0018* (2013.01); *B61L 27/20* (2022.01); *B61L 2027/204* (2022.01)

(58) Field of Classification Search
CPC . B61L 15/0018; B61L 27/20; B61L 2027/204
See application file for complete search history.

(56) References Cited

U.S. PATENT DOCUMENTS

2017/0129512 A1 5/2017 Shubs, Jr. et al.

FOREIGN PATENT DOCUMENTS

| | | | |
|---|---|---|---|
| CN | 102012809 | A | 4/2011 |
| CN | 105139714 | A | 12/2015 |
| CN | 106251385 | A | 12/2016 |
| CN | 109343339 | A | 2/2019 |
| CN | 109656820 | A | 4/2019 |

OTHER PUBLICATIONS

The World Intellectual Property Organization (WIPO) International Search Report for PCT/CN2020/108730 dated Oct. 27, 2020 5 pages (with translation).

(Continued)

*Primary Examiner* — Mathew Franklin Gordon
(74) *Attorney, Agent, or Firm* — Wenye Tan

(57) ABSTRACT

A train signal system includes a first subsystem, a second subsystem, built by an LUA framework, and a control platform configured to perform communication with the first subsystem by using a first interface, perform communication with the second subsystem by using a second interface, and transmit an LUA script instruction to the second subsystem by using the second interface, so that the second subsystem executes the LUA script instruction.

11 Claims, 4 Drawing Sheets

(56) References Cited

OTHER PUBLICATIONS

Yi, Application Interface Automatic Testing Framework Design and Implementation of Embedded System Based on Lua Script, Chinese Master's Theses Full-text Database Information Science and Technology, 2014, Jan. 15, 2014.

Wang, et al., Research on Automatic Test Script of Train Control Center Based on Lua, Techniques of Automation and Applications, vol. 32, No. 3, Dec. 31, 2013 (Dec. 31, 2013), ISSN: 1003-7241, pp. 53-57.

TRAIN SIGNAL SYSTEM AND LINKAGE METHOD THEREFOR

CROSS-REFERENCE TO RELATED APPLICATIONS

This application is a national stage entry under 35 U.S.C. § 371 of International Application No. PCT/CN2020/108730, filed on Aug. 12, 2020, which claims priority to Chinese Patent Application No. 201910748535.X, filled on Aug. 14, 2019 and entitled "TRAIN SIGNAL SYSTEM AND LINKAGE METHOD THEREFOR", the entire contents of all of which are incorporated herein by reference.

FIELD

The present disclosure relates to the field of communication technologies, and in particular, to a train signal system and a train signal system linkage method.

BACKGROUND

In order to achieve linkage among a plurality of signal subsystems in a train signal system, an interface framework agent is usually added to a to-be-operated or to-be-tested system, and inherent code is written into the framework to realize a corresponding function, or a dynamic link library (DLL) is used to test the framework and then an interface framework agent for which test or control is configured is dynamically added. However, the inherent code has poor functional flexibility. In addition, the DLL uses machine code, and therefore the compatibility is poor and upgrade operations are complicated.

In addition, an operating or test platform of the train signal system generally supports only one operating environment, that is, a personal computer (PC) or a physical device. Due to limited conditions and performance requirements of the system, it is very difficult for the physical device to embody a plurality of results in parallel. Due to factors such as different application scenarios, diversified communication modes, and instability of monitoring devices, it is quite difficult for the PC to compile stable and reliable programs.

SUMMARY

The present disclosure is intended to resolve at least one of the technical problems in the related art to some extent. To this end, the present disclosure is intended to provide a train signal system. The system uses an LUA language. Therefore, various newly added requirements of a train can be completed without a need to modify tool code. In this way, the workload is reduced and the efficiency is improved. In addition, the system supports functional configuration of both a PC and a physical device, and can vary with applications, which adapts to diverse and varying train requirements.

The present disclosure is further intended to provide a linkage method of a train signal system.

In order to achieve the foregoing objectives, an embodiment of the present disclosure provides a train signal system. The train signal system includes: a first subsystem; a second subsystem, built by using an LUA framework; and a control platform, configured to perform communication with the first subsystem by using a first interface, perform communication with the second subsystem by using a second interface, and transmit an LUA script instruction to the second subsystem by using the second interface, so that the second subsystem executes the LUA script instruction.

According to the train signal system in this embodiment of the present disclosure, the control platform is configured to perform communication with the first subsystem by using the first interface, perform communication with the second subsystem by using the second interface, and transmit the LUA script instruction to the second subsystem by using the second interface, so that the second subsystem executes the LUA script instruction. The system uses an LUA language. Therefore, various newly added requirements of a train can be completed without a need to modify tool code. In this way, the workload is reduced, and the efficiency is improved. In addition, the system supports functional configuration of both a PC and a physical device, and can vary with applications, which adapts to diverse and varying train requirements.

In order to achieve the foregoing objectives, an embodiment of a second aspect of the present disclosure provides a linkage method of a train signal system. The train signal system includes: a first subsystem, a second subsystem, and a control platform, wherein the second subsystem is built by using an LUA framework, and the linkage method includes the following steps: performing, by the control platform, communication with the first subsystem by using a first interface, and performing, by the control platform, communication with the second subsystem by using a second interface; and transmitting, by the control platform, an LUA script instruction to the second subsystem by using the second interface, so that the second subsystem executes the LUA script instruction.

According to the linkage method of a train signal system in this embodiment of the present disclosure, the control platform is configured to perform communication with the first subsystem by using the first interface, perform communication with the second subsystem by using the second interface, and transmit the LUA script instruction to the second subsystem by using the second interface, so that the second subsystem executes the LUA script instruction. The method uses an LUA language. Therefore, various newly added requirements of a train can be completed without a need to modify tool code. In this way, the workload is reduced, and the efficiency is improved. In addition, the system supports functional configuration of both a PC and a physical device, and can vary with applications, which adapts to diverse and varying train requirements.

BRIEF DESCRIPTION OF THE DRAWINGS

The foregoing and/or additional aspects and advantages of the present disclosure will become apparent and comprehensible in the description made with reference to the following accompanying drawings.

DETAILED DESCRIPTION

Figure 1:
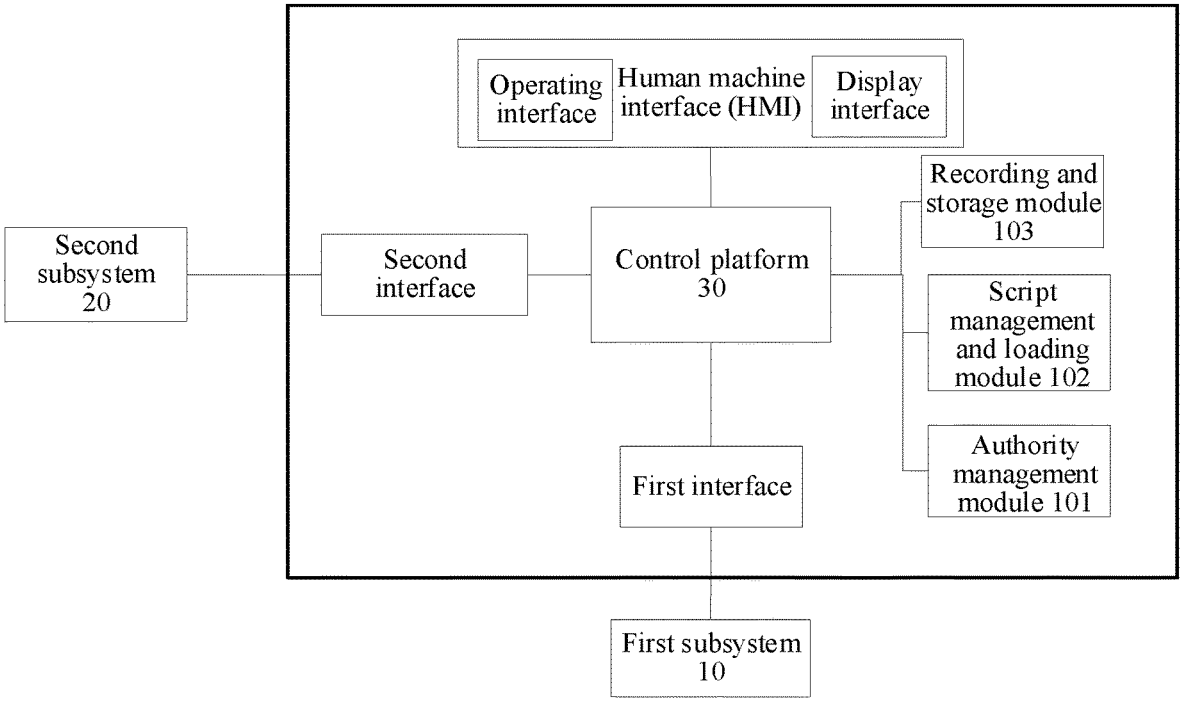
FIG. 1 is a schematic block diagram of a train signal system according to an embodiment of the present disclosure.

The following describes embodiments of the present disclosure in detail. Examples of the embodiments are shown in the accompanying drawings, and same or similar reference numerals in all the accompanying drawings indicate same or similar components or components having same or similar functions. The embodiments described below with reference to the accompanying drawings are exemplary and used only for explaining the present disclosure, and should not be construed as a limitation on the present disclosure.

A train signal system and a train signal system linkage method in the embodiments of the present disclosure are described below with reference to the drawings.

FIG. 1 is a schematic block diagram of a train signal system according to an embodiment of the present disclosure. As shown in FIG. 1, the system includes a first subsystem 10, a second subsystem 20, and a control platform 30. The second subsystem 20 is built by using an LUA framework. The control platform 30 is configured to perform communication with the first subsystem 10 by using a first interface, perform communication with the second subsystem 20 by using a second interface, and transmit an LUA script instruction to the second subsystem 20 by using the second interface, so that the second subsystem 20 executes the LUA script instruction.

In this embodiment of the present disclosure, the first interface may be a PC interface, and the second interface may be a remote invocation interface.

Specifically, as shown in FIG. 1, the train signal system includes the control platform 30 and a to-be-operated system or an auxiliary operating system, that is, the first subsystem 10 and the second subsystem 20. The control platform 30 is a master control end of the train signal system, and is connected to a test or operating platform side server, a to-be-operated or to-be-tested system, an auxiliary system, a monitoring terminal, and the like, and generally uses a PC as a carrier. The control platform 30 is configured to load and parse the LUA script instruction, convert the LUA script instruction to a control sequence corresponding to a to-be-executed task to control a corresponding terminal to perform the task, generate reports according to a plurality of status changes (which are acquired directly or by using the monitoring terminal) after the terminal performs the task, and summarize and store the reports in a human machine interface (HMI). The HMI includes an operation interface and a display interface. The HMI is configured to monitor various status information and related logs of each system, collect status change information of the test terminal and a dependent environment thereof, and feedback status change information to the control platform 30.

The second subsystem 20 is a main to-be-operated signal system and to-be-tested object. Certainly, the second subsystem 20 may be used as an auxiliary operating system. That is to say, when other systems are used as the to-be-operated signal system and the to-be-tested object, the second subsystem 20 is used as the auxiliary operating system. When the second subsystem 20 is used as the auxiliary operating system, the second subsystem may be configured to assist the control platform 30 to control the terminal in execution of the task. In most scenarios, the terminal is selective. However, in some scenarios, the terminal is required to be determined separately. For example, simulation of computer interlocking (CI) apparatuses of some non-operating trains require only a single CI terminal to implement.

In the present disclosure, as shown in FIG. 1, the train signal system may further include: an authority management module 101, configured for expansion of a subsequent function of the control platform 30; a script management and loading module 102, configured to load the LUA script instruction, so that the control platform 30 designs an operating command according to a loaded script, and transmit the operating command to the second subsystem 20 by using second interface to control and execute the subsystem; and a recording and storage module 103, configured to record test data for subsequent debugging.

An LUA language is a dynamic script language and interpretive language that does not require a compilation time and allows a user to compile an application program during operation. Therefore, by means of secondary development by using the LUA script and by using a keyword-driven model (a keyword may be a character or a character string, and one keyword corresponds to one operating command), a user event can be effectively separated from interaction with a server and external data can be effectively separated from logic. In the train signal system, all events realize configuration files of all interfaces, and the configuration files generate corresponding LUA script. Therefore, the interaction interface data can be changed anytime and anywhere. According to the present disclosure, only a function is exposed to the LUA script through the interface, so that a user does not need to modify tool code, and various functional configurations can be completed by only customizing the LUA script. For data in a test case that requires to be frequently modified, only the configuration file of each interface is directly modified. Therefore, the time required for compiling, translating, linking, and operating a program language is significantly reduced. For newly added test requirements and functions, the train signal system may vary with applications, and can adapt to diverse and varying test situations without a need to modify original system code. In this way, the workload is reduced, and the efficiency is improved.

The second subsystem 20 may operate in two environments, that is, a PC and a physical device. When the train signal system operates in a simulated environment, the second subsystem 20 operates on the PC as the control platform 30. When operating in an actual environment, the second subsystem 20 operates on the physical device. The control platform 30 may perform communication with the first subsystem 10 by using the first interface, and may further perform communication with the second subsystem 20 by using the second interface. Therefore, the control platform supports the functional configuration of both the PC and the physical device. The PC can quickly verify logic of the to-be-tested subsystem, so that the physical device can be more accurately applied to an actual field operation. The schematic diagrams of the PC drive event and the physical device drive event are shown in FIG. 2.

Figure 2:
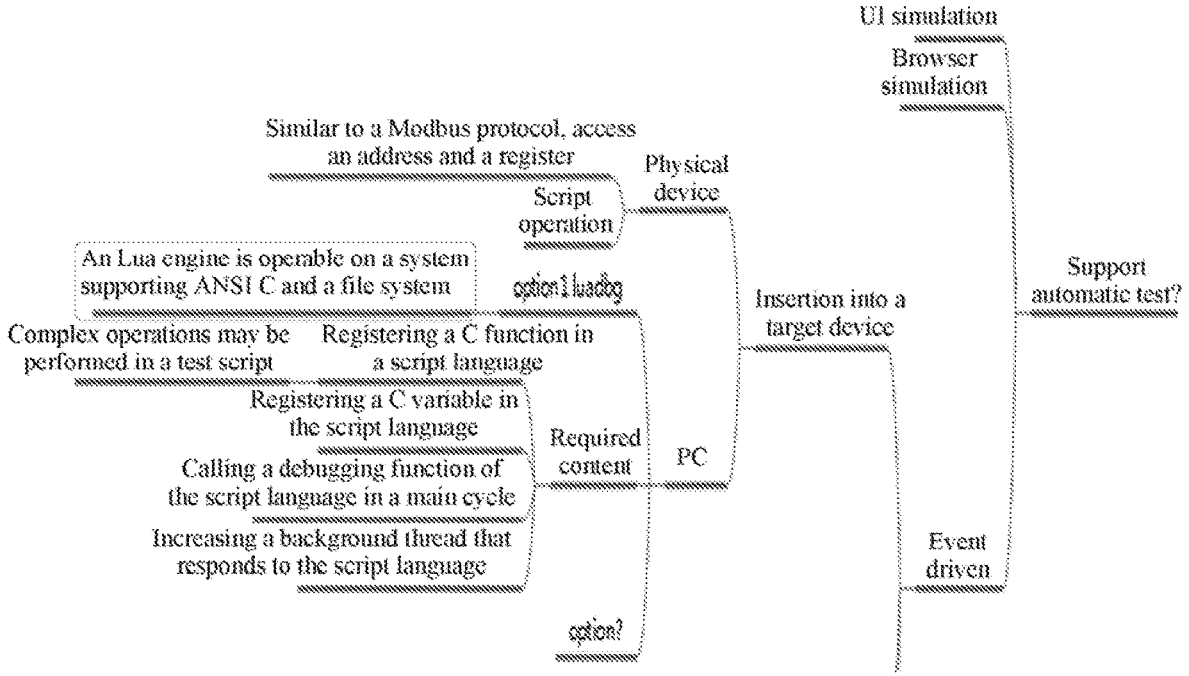
FIG. 2 is a schematic diagram of a PC drive event and physical device drive event according to an embodiment of the present disclosure.

It can be learned from FIG. 2 that a biggest difference between the physical device and the PC is that the physical device embodies more operations of control interfaces for protocols related to a physical object and device registers. The PC can simulate the operations, but the PC emphasizes registration of an interaction relationship between code and an instruction and receipt of background thread logic. The PC can embody various configuration logic by using real-time results. Due to limited conditions and performance requirements of the system, it is very difficult for the physical object to embody results in parallel.

It can be learned from the above that the train signal system of the present disclosure uses an LUA language. Therefore, various newly added requirements of a train can be completed without a need to modify tool code. In this way, the workload is reduced, and the efficiency is improved. In addition, the system supports functional configuration of both a PC and a physical device, and can vary with applications, which adapts to diverse and varying train requirements.

Figure 3:
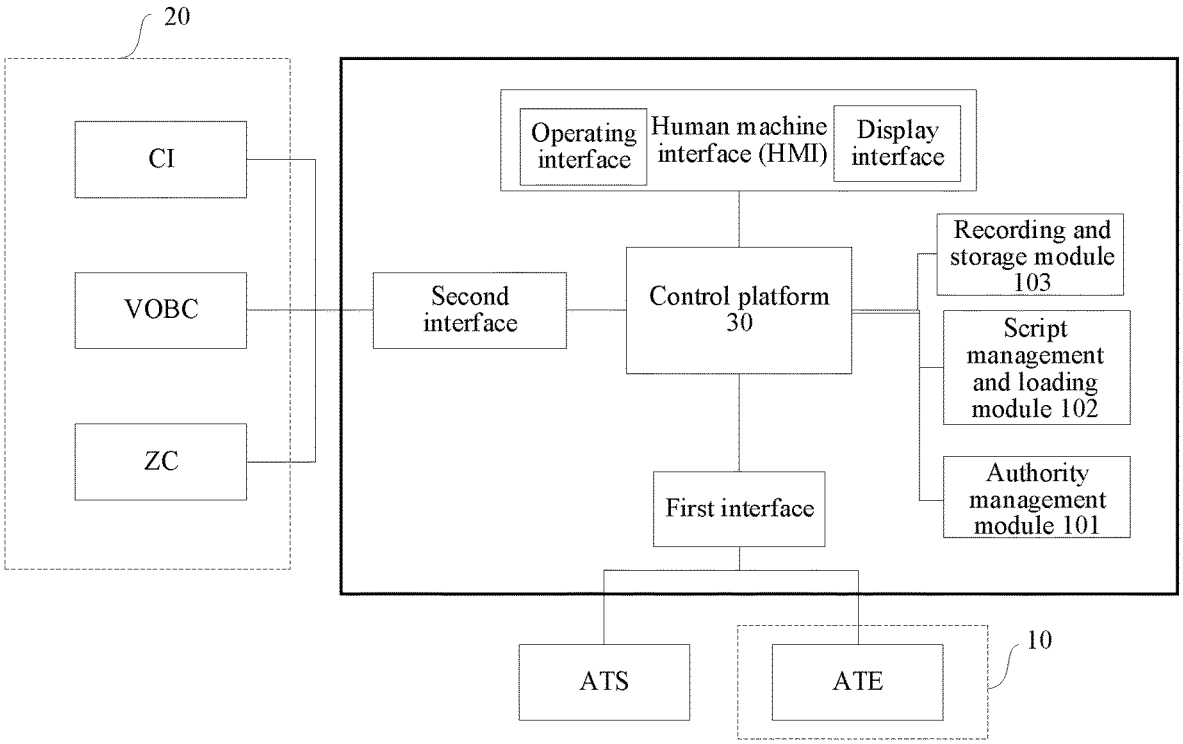
FIG. 3 is a schematic block diagram of a train signal system according to another embodiment of the present disclosure.

In an embodiment of the present disclosure, as shown in FIG. 3, the first subsystem 10 may include an automatic train supervision (ATS) system. The second subsystem 20 may include at least one of a vehicle on board controller (VOBC), a computer interlocking (CI) apparatus, or a zone controller (ZC).

Furthermore, as shown in FIG. 3, the train signal system of the present disclosure may further include an automatic test equipment (ATE). The control platform 30 communicates with the ATE by using the first interface. The ATE is an auxiliary operating system, and is configured to assist the control platform 30 in control of the operating terminal to execute a specific task.

Figure 4:
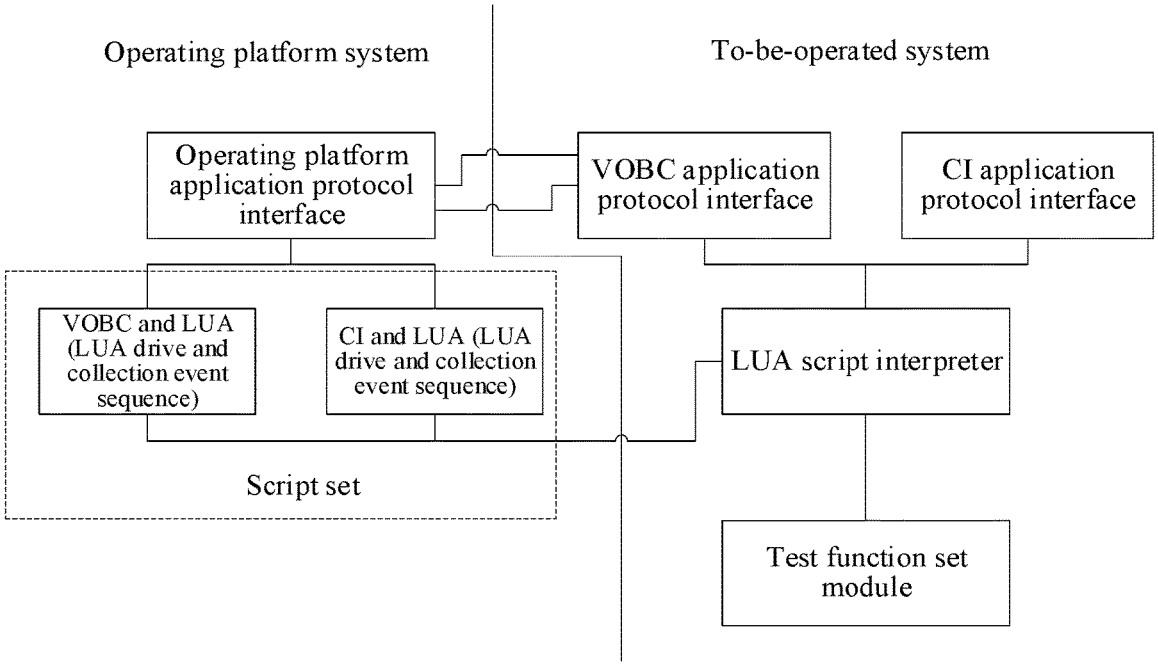
FIG. 4 is a schematic diagram of an LUA framework according to an embodiment of the present disclosure.

According to an embodiment of the present disclosure, the VOBC, the CI apparatus, and the ZC included in the second subsystem 20 each are a software system, and each are built by using the LUA framework. As shown in FIG. 4, the LUA framework may include a test function set module, an LUA script interpreter, and a script set. The test function set module is configured to store a test function set. The test function set includes a plurality of test functions. The LUA script interpreter is configured to parse the LUA script instruction and call a corresponding test function in the test function set for testing. The script set is configured to store the LUA script instruction to configure and coordinate control of various function.

Specifically, the LUA control means that the control platform 30 calls the code (that is, executes the LUA script instruction) by using the second interface. As an example, the code may be compiled by using a C language (C programming Language, which is a program design language). No limitation is imposed on this in the present disclosure. To this end, the LUA provides a function of loading a dynamic library. It can be learned from FIG. 4 that, the LUA framework has three parts: the test function set module, the LUA script interpreter, and the script set. The LUA script interpreter includes a general-purpose library.

The test function set module, as a test driving module in the common sense, is configured to call a to-be-tested application programming interface (API), acquire a returned value of the to-be-tested API, and encapsulate the interface for call of the script. The test function set module may be further configured to plan an operation function set of a related application by using a design mode of a dynamic resource library file. Since the dynamic resource library file is dynamically loaded, the LUA script interpreter is not required to be changed due to a newly added test set. In addition, each to-be-tested interface module may use a different dynamic resource library file to facilitate management and configuration.

The LUA script interpreter is configured to add requirements based on an original open source LUA architecture, parse the LUA script instruction transferred by the second interface, and call the corresponding test function in the test function set for testing, so as to operate and acquire an information status.

The script set includes an LUA drive and collection event sequence, is configured to configure and coordinate control of various functions, and realizes simple logic designs in the script. The script set includes three parts: a case script, a control script, and an auxiliary script. The case script is configured to establish a simple mapping relationship and is responsible for design of steps and logic of some cases. The control script is configured to determine a range and a condition of a test case, an execution number, whether logs are required, and the like. The auxiliary script is configured to test auxiliary information such as logs and monitor a system resource (such as a central processing unit and a memory).

How the control platform 30 realizes linkage of a plurality of subsystems according to the loaded LUA script instruction is described below in detail by using specific examples.

Figure 5:
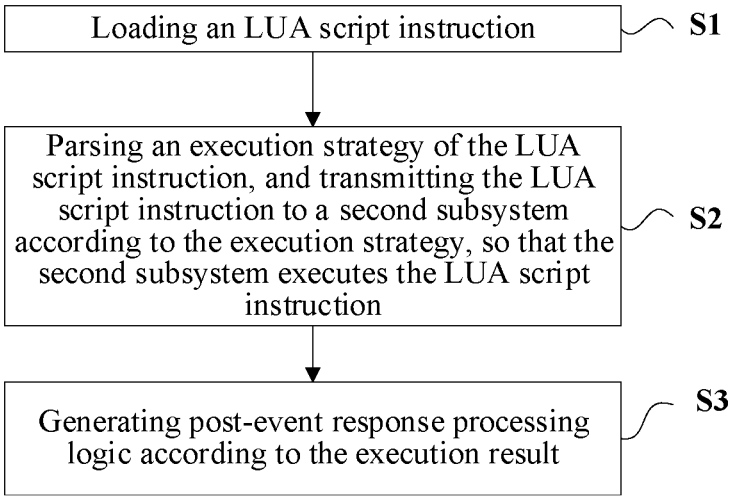
FIG. 5 is a schematic diagram of linkage control logic according to an embodiment of the present disclosure.

According to an embodiment of the present disclosure, the control platform 30 may be further configured to generate linkage control logic. As shown in FIG. 5, the linkage control logic may include the following:

S1: Loading the LUA script instruction.

S2: Parsing an execution policy of the LUA script instruction, and transmitting the LUA script instruction to the second subsystem according to the execution policy, so that the second subsystem executes the LUA script instruction.

S3: Generating post-event response processing logic according to the execution result.

Specifically, the train signal system provided in the present disclosure may be applied to a train based on the LUA language. By means of a script import technology and a multi-threaded interaction technology, the test platform and the HMI can process routed linkage among a plurality of subsystems at (for example, interaction between the CI device and an ATE simulation system and a ZC system). The linkage requires each to-be-operated or to-be-tested system and other auxiliary systems to add a control framework and linkage control logic of the to-be-tested system to respective system content. How to realize the linkage control logic between the control platform 30 and each subsystem has great impact on operation stability, usability, and expansibility.

To this end, the control platform 30 of the present disclosure automatically generates the linkage control logic. The linkage control logic uses LUA grammar as a grammatical rule for formula editing, and supports powerful logic design functions such as logic determination, circulation, customization of variables, a mathematical function library, and a character string function library.

When a linkage function of the train signal system is triggered, a linkage function icon flashes on the HMI to prompt an operation. By means of the linkage function screen displayed by the HMI, the operator may transmit a related control command of the linkage by using the control platform 30 or automatically trigger an initial event by using the LUA script instruction. The control platform 30 loads an LUA script instruction for each subsystem, parses the LUA script instruction to acquire an execution policy of the LUA script instruction, and transmits the LUA script instruction to the to-be-controlled and operated subsystem such as the CI, the VOBC, or the ZC by using the second interface according to the execution policy, thereby controlling and executing the subsystems.

The LUA script instruction may be designed with different execution policies in different manners, such as turning on and off a signal light, and controlling a switch. The LUA script instruction mainly includes a driving event and a collection event. For example, during control of the CI, the switch is turned by driving a corresponding system by using the LUA drive event and then operating a switch device by a corresponding device. When a response to a status of the signal light is required to be acquired, required collection information of the signal light may be transmitted by using the LUA collection event. As an example, the LUA script instruction may be a sequence of the drive event and the collection event in interaction. For example, when the train passes through two transponders, the train is to be changed from a non-positioned mode to a positioned mode. The process involves interaction of a plurality of events, and includes the following: The control platform 30 is required to periodically transmit, to a VOBC detection module of the VOBC system in the second subsystem 20, a driving interface event indicating current on-board status information. When the train passes through two transponders, it can be learned that the train having the VOBC system is in a positioned state. At this time, the VOBC is upgraded to coded mode communication based train control (CBTC, which is a CBTC-based automatic train protection mode) (CMC) by a series of operations. In the process, the status information of the VOBC and the control information for controlling the VOBC are both acquired by using the LUA script instructions inputted to the interface.

After the second subsystem 20 executes the LUA script instruction according to the execution policy, the control platform 30 further determines a next execution manner according to an execution result of the second subsystem 20, that is, generates post-event response processing logic. The post-event response processing logic is mainly realized by using the execution result, and failure processing logic of the action is preset by using the LUA script instruction. The logic may include skipping the action in case of failure, suspension of linkage, automatic re-execution, manual intervention, and the like. For example, after the control platform 30 controls the turning of the switch according to the LUA script instruction, the control platform further determines whether the execution succeeds. If the execution succeeds, the control platform 30 controls the HMI to provide a prompt and end the program. If the execution fails, the control platform performs automatic re-execution and controls the HMI to provide a prompt.

Further, the above linkage control logic may further include initializing the first subsystem 10 and the second subsystem 20.

Specifically, before the LUA script instruction is transmitted to the second subsystem 20 according to the execution policy, the subsystems involved in the execution policy are required to be initialized. For example, VOBC upgrade/degrade procedures are required to be tested, and the VOBC, and the system such as the CI, the ATE, and the ZC are required to be opened and initial variable values are required to be set for initialization.

In conclusion, according to the train signal system, in this embodiment of the present disclosure, the control platform is configured to perform communication with the first subsystem by using the first interface, perform communication with the second subsystem by using the second interface, and transmit the LUA script instruction to the second subsystem by using the second interface, so that the second subsystem executes the LUA script instruction. The system uses an LUA language. Therefore, various newly added requirements of a train can be completed without a need to modify tool code. In this way, the workload is reduced, and the efficiency is improved. In addition, the system supports functional configuration of both a PC and a physical device, and can vary with applications, which adapts to diverse and varying train requirements.

Based on the above train signal system, the present disclosure further provides a linkage method of a train signal system. Since the method embodiment of the present disclosure is based on the above system embodiment, for details that are not disclosed in the method embodiment, refer to the above system embodiment, and the details are not described in this method embodiment.

Figure 6:
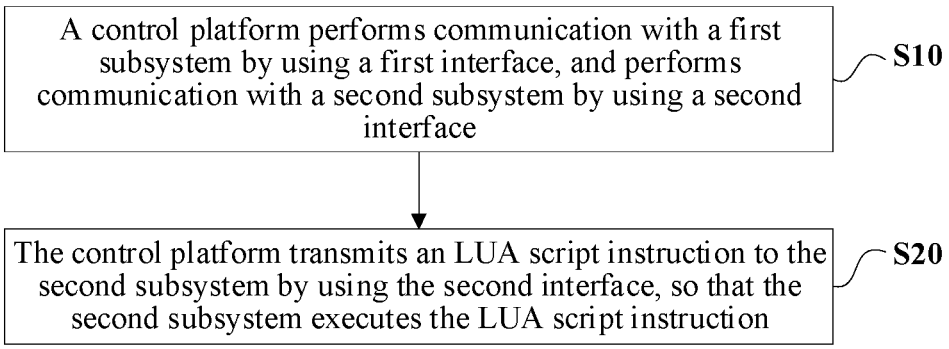
FIG. 6 is a flowchart of a linkage method of a train signal system according to an embodiment of the present disclosure.

FIG. 6 is a flowchart of a linkage method of a train signal system according to an embodiment of the present disclosure. As shown in FIG. 1, the train signal system includes a first subsystem, a second subsystem, and a control platform. The second subsystem is built by using an LUA framework. As shown in FIG. 6, the linkage method of a train signal system may include the following steps:

S10: The control platform performs communication with the first subsystem by using a first interface, and performing, by the control platform, communication with the second subsystem by using a second interface.

S20: The control platform transmits an LUA script instruction to the second subsystem by using the second interface, so that the second subsystem executes the LUA script instruction.

According to an embodiment of the present disclosure, the instruction includes the LUA script instruction.

Further, according to an embodiment of the present disclosure, the first test subsystem includes an ATS system.

According to an embodiment of the present disclosure, the second test subsystem includes at least one of a VOBC, a CI apparatus, or a ZC.

According to an embodiment of the present disclosure, the train signal system further includes an ATE. The linkage method further includes the following step: performing, by the control platform, communication with the ATE by using the first interface.

According to an embodiment of the present disclosure, the control platform generates linkage control logic. The linkage control logic includes loading an LUA script instruction; parsing an execution policy of the LUA script instruction and transmitting the LUA script instruction to the second subsystem according to the execution policy, so that the second subsystem executes the LUA script instruction; and generating post-event response processing logic according to the execution result.

Furthermore, according to an embodiment of the present disclosure, the linkage control logic may further include initializing the first subsystem and the second subsystem.

In conclusion, according to the linkage method of a train signal system in this embodiment of the present disclosure, the control platform is configured to perform communication with the first subsystem by using the first interface, perform communication with the second subsystem by using the second interface, and transmit the LUA script instruction to the second subsystem by using the second interface, so that the second subsystem executes the LUA script instruction. The method uses an LUA language. Therefore, various newly added requirements of a train can be completed without a need to modify tool code. In this way, the workload is reduced, and the efficiency is improved. In addition, the system supports functional configuration of both a PC and a physical device, and can vary with applications, which adapts to diverse and varying train requirements.

In descriptions of the present disclosure, it should be understood that the terms such as "first" and "second" are used only for the purpose of description, and should not be understood as indicating or implying the relative importance or implicitly specifying the number of the indicated technical features. Therefore, features defining "first" and "second" can explicitly or implicitly include at least one of the features. In the descriptions of the present disclosure, unless explicitly specified, "multiple" means at least two, for example, two or three.

In the present disclosure, it should be noted that unless otherwise explicitly specified and limited, the terms "mount", "connect", "connection", and "fix" should be understood in a broad sense. For example, a connection may be a fixed connection, a detachable connection, or an integral connection; or the connection may be a mechanical connection or an electrical connection; or the connection may be a direct connection, an indirect connection through an intermediary, or internal communication between two elements or mutual action relationship between two elements, unless otherwise specified explicitly. Those of ordinary skill in the art can understand specific meanings of the above terms in the present disclosure in specific situations.

In the present disclosure, unless expressly stated and defined otherwise, a first feature "on" or "beneath" a second feature may be that the first and second features are in direct contact, or that the first and second features are in indirect contact via an intermediary Moreover, the first feature "over", "above" and "up" the second feature may be that the first feature is directly above or obliquely above the second feature, or simply indicates that a horizontal height of the first feature is higher than that of the second feature. The first feature "under", "below" and "down" the second feature may be that the first feature is directly below or obliquely below the second feature, or simply indicates that a horizontal height of the first feature is less than that of the second feature.

In the description of the present specification, reference to the description of the terms "one embodiment", "some embodiments", "examples", "specific examples", or "some examples", etc. means that specific features, structures, materials, or characteristics described in connection with the embodiment or example are included in at least one embodiment or example of the present disclosure. In this specification, exemplary descriptions of the foregoing terms do not necessarily refer to a same embodiment or example. Moreover, the specific features, structures, materials, or characteristics described may be combined in any one or more embodiments or examples in a suitable manner. In addition, different embodiments or examples described in the present specification, as well as features of different embodiments or examples, may be integrated and combined by those skilled in the art without contradicting each other.

While the embodiments of the present disclosure have been shown and described above, it is to be understood that the above-described embodiments are illustrative and not to be construed as limiting the present disclosure, and changes, modifications, substitutions, and variations of the above-described embodiments may occur to those of ordinary skill in the art within the scope of the disclosure.

What is claimed is:

1. A train signal system, comprising:

a first subsystem;

a second subsystem, built by an LUA framework; and a control platform, configured to perform communication with the first subsystem by using a first interface, perform communication with the second subsystem by using a second interface, and transmit an LUA script instruction to the second subsystem by using the second interface, so that the second subsystem executes the LUA script instruction.

2. The train signal system according to claim 1, wherein the first subsystem comprises an automatic train supervision (ATS) system.

3. The train signal system according to claim 1, wherein the second subsystem comprises: at least one of a vehicle on board controller (VOBC), a computer interlocking (CI) apparatus, or a zone controller (ZC).

4. The train signal system according to claim 1, wherein the LUA framework comprises:

a test function set module, configured to store a test function set, wherein the test function set comprises a plurality of test functions;

an LUA script interpreter, configured to parse the LUA script instruction and call a corresponding test function in the test function set for testing; and a script set, configured to store the LUA script instruction.

5. The train signal system according to claim 1, further comprising:

an automatic test equipment (ATE), wherein the control platform is configured to perform communication with the ATE by using the first interface.

6. The train signal system according to claim 1, wherein the control platform is further configured to generate linkage control logic, and when executed on the control platform, the linkage control logic is configured to:

load the LUA script instruction;

parse an execution policy of the LUA script instruction, and transmit the LUA script instruction to the second subsystem according to the execution policy, to allow the second subsystem to execute the LUA script instruction; and generate post-event response processing logic according to the execution.

7. A linkage method of a train signal system, the linkage method being applicable to a control platform, the linkage method comprising:

performing, by the control platform, communication with a first subsystem by using a first interface, and performing, by the control platform, communication with a second subsystem by using a second interface, wherein the second subsystem is built by an LUA framework; and transmitting, by the control platform, an LUA script instruction to the second subsystem by using the second interface, so that the second subsystem executes the LUA script instruction.

8. The linkage method of a train signal system according to claim 7, wherein the first subsystem comprises an automatic train supervision (ATS) system.

9. The linkage method of a train signal system according to claim 7, wherein the second subsystem comprises: at least one of a vehicle on board controller (VOBC), a computer interlocking (CI) apparatus, or a zone controller (ZC).

10. The linkage method of a train signal system according to claim 7, wherein the train signal system further comprises an automatic test equipment (ATE), and the linkage method further comprises:

performing, by the control platform, communication with the ATE by using the first interface.

11. The linkage method of a train signal system according to claim 9, further comprising:

generating, by the control platform, linkage control logic, wherein when executed on the control platform, the linkage control logic is configured to:

load the LUA script instruction;

parse an execution policy of the LUA script instruction, and transmit the LUA script instruction to the second subsystem according to the execution policy, so that the second subsystem executes the LUA script instruction; and generate post-event response processing logic according to the execution result.

* * * * *